United States Patent [19]

Gilbert

[11] 4,327,459

[45] May 4, 1982

[54] COMBINED STEAM AND VACUUM CLEANER

[75] Inventor: Jack J. Gilbert, Suffern, N.Y.

[73] Assignee: Metropolitan Vacuum Cleaner Co., Inc., Suffern, N.Y.

[21] Appl. No.: 139,948

[22] Filed: Apr. 14, 1980

[51] Int. Cl.[3] ..... A47L 7/00

[52] U.S. Cl. ..... 15/321; 219/273; 219/275

[58] Field of Search ..... 15/321, 322, 339; 68/222; 219/273, 275, 284, 286, 287

[56] References Cited

U.S. PATENT DOCUMENTS

| | | | |
|---|---|---|---|
| 1,437,331 | 11/1922 | Alexander | 15/321 X |
| 1,628,784 | 5/1927 | Katzman | 219/275 |
| 2,531,370 | 11/1950 | Thompson | 15/321 |
| 2,861,838 | 11/1958 | Wyatt et al. | 219/273 X |
| 3,262,146 | 7/1966 | Hays | 15/321 |
| 3,774,261 | 11/1973 | Colt | 15/321 |
| 4,206,340 | 6/1980 | Osrow et al. | 219/275 X |

*Primary Examiner*—Chris K. Moore
*Attorney, Agent, or Firm*—Leo C. Krazinski

[57] ABSTRACT

A portable machine for steam cleaning carpets, rugs, automotive engines and soiled areas including an electrolytic generator for substantially instant production of steam, a positive displacement pump for delivering a water-chemical solution from a tank to the electrolytic generator and from the electrolytic generator a discharge of steam via a flexible hose and nozzle onto a soiled area including automotive engines. When adapted primarily for rug and carpet cleaning the machine includes an air pump and solenoid for delivering detergent from a tank to the nozzle and a vacuum motor with nozzle for picking up excess moisture and dirt particles released by the steam solution.

13 Claims, 5 Drawing Figures

Fig. 1.
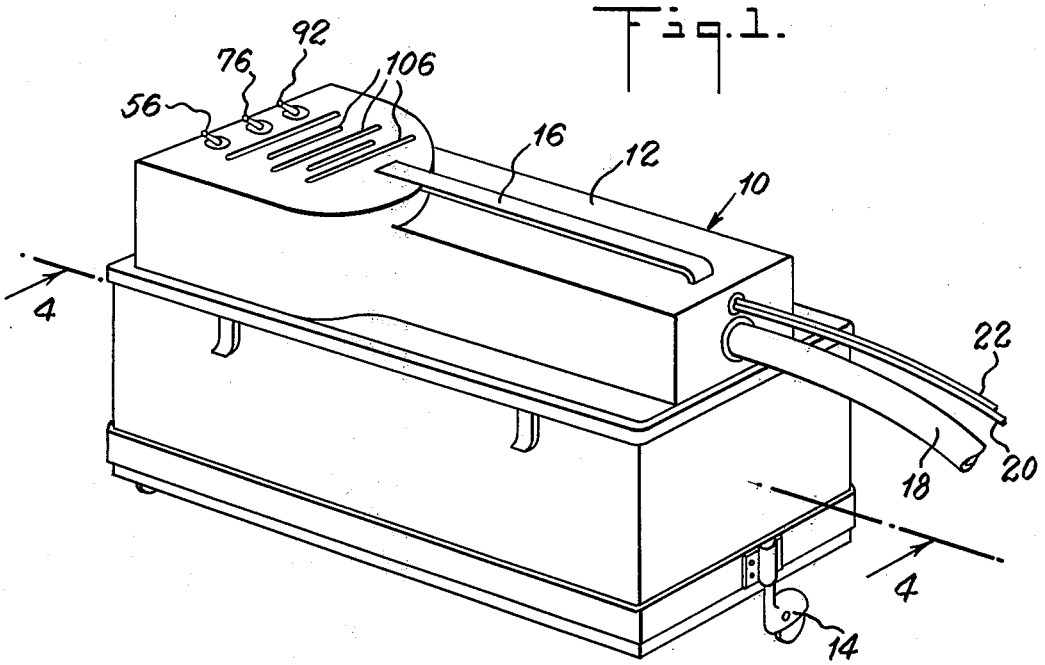
Fig. 2.
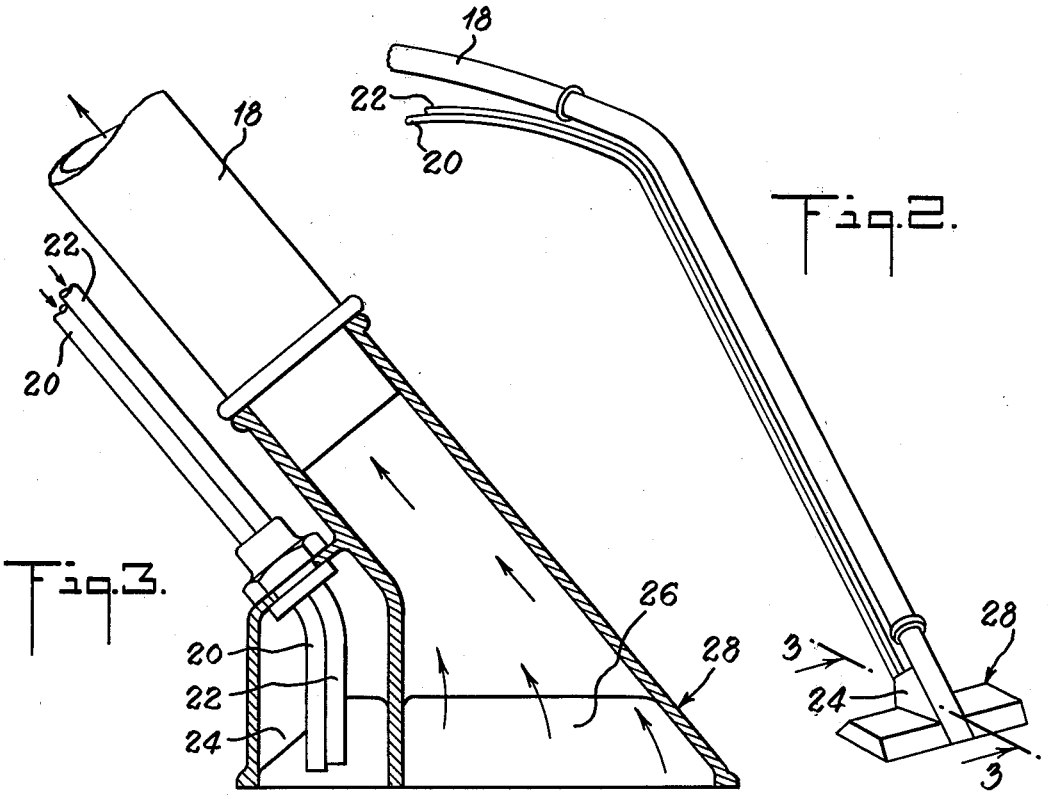
Fig. 3.

COMBINED STEAM AND VACUUM CLEANER

BACKGROUND OF THE INVENTION

1. Field of the Invention

The present invention relates to cleaning machines, and more particularly, to a compact, portable cleaning machine that generates steam in a matter of seconds for use in cleaning carpets, rugs and household items, as well as, automotive engines and soiled areas.

2. Description of Prior Art

Prior to the subject invention, as far as applicant is aware from a search of the Patent Office records, the production of substantially instant steam by an electrolytic steam generator in a portable cleaning machine has not been taught. U.S. Pat. No. 4,034,203 discloses a portable electrically heated steam generator that includes an electrical resistance heating element in a non-metallic tube through which liquid to be converted to steam can flow. U.S. Pat. No. Re. 27,792 discloses a cleaning machine for cleaning carpets that includes a heater which raises the temperature of the liquid so that it is very hot, obviously not steam, when sprayed. U.S. Pat. No. Re. 26,950 discloses a steam-vacuum generator for rug and upholstery cleaning in which high pressure steam is applied to one chamber of a two chamber cleaner nozzle and simultaneously creating a vacuum in the other chamber. A conventional calrod (resistance) heating element generates the steam.

SUMMARY OF THE INVENTION

Accordingly, it is a primary object of the present invention to provide an improved cleaning machine having a substantially instantaneous source of steam for the cleaning operation.

Another object of the invention is to provide an improved portable light weight steam cleaning machine.

Still another object of the invention is to provide a simple, low cost and efficient cleaning machine for steam cleaning and vacuuming carpets, rugs and the like.

Other and further objects will be obvious upon an understanding of the illustrative embodiment about to be described, or will be indicated in the appended claims and various advantages not referred to herein will occur to one skilled in the art upon employment of the invention in practice.

In accordance with the present invention, the foregoing objects are accomplished by providing a combined steam and vacuum cleaner that produces steam in a matter of seconds by an electrolytic steam generator comprising a small sealed container having an inlet port and outlet port and carrying two carbon electrodes that are energized by electric current. The inlet port is connected to a positive displacement (suction) water pump for pumping liquid solution from a tank to the electrolytic steam generator, while the outlet port is connected through a flexible hose to a spray nozzle mounted upon a vacuum pick-up nozzle. A liquid detergent solution is provided in a container having an inlet port connected to an air pump and an outlet port connected through a solenoid actuated valve and flexible hose to the spray nozzle where the detergent is mixed with the steam. A vacuum motor in creating suction at its pick-up nozzle will remove excess moisture and dirt particles that are released by the steam-detergent mixture and will trap them in a separate container.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a perspective view of a body portion of the cleaner.

FIG. 2 is a perspective view of the pick-up nozzle and handle for the cleaner.

FIG. 3 is a sectional view taken on line 3—3 of FIG. 2 showing the steam-detergent mixing chamber and vacuum motor pick-up chamber of the pick-up nozzle.

Referring now to the drawings in detail, there is shown in FIG. 1 a combined steam-vacuum cleaning machine 10 for cleaning carpets, rugs and the like. The machine 10 includes a casing 12 mounted on floor engaging casters 14, a handle 16, a vacuum flexible hose 18, a steam hose 20 and a detergent hose 22. As seen in FIGS. 2 and 3, the steam and detergent hoses 20 and 22, respectively, are preferably of twin tubing and terminate in a mixing chamber 24, while the vacuum hose 18 ends in a suction chamber 26, both the mixing chamber 24 and suction chamber 26 forming a cleaning nozzle 28 for the machine 10.

Referring now to FIGS. 4 and 5, there is shown the apparatus within the casing 12 (FIG. 4) and apparatus corresponding to those shown in the block diagram (FIG. 5). The essential and most important component of the cleaning machine 10 is an electrolytic steam generator 30 that can generate steam within a period of 7 seconds. The generator 30 consists of two spaced carbon rods 32 sealed in a container 34 having an inlet port 36 and outlet port 38.

Figure 4:
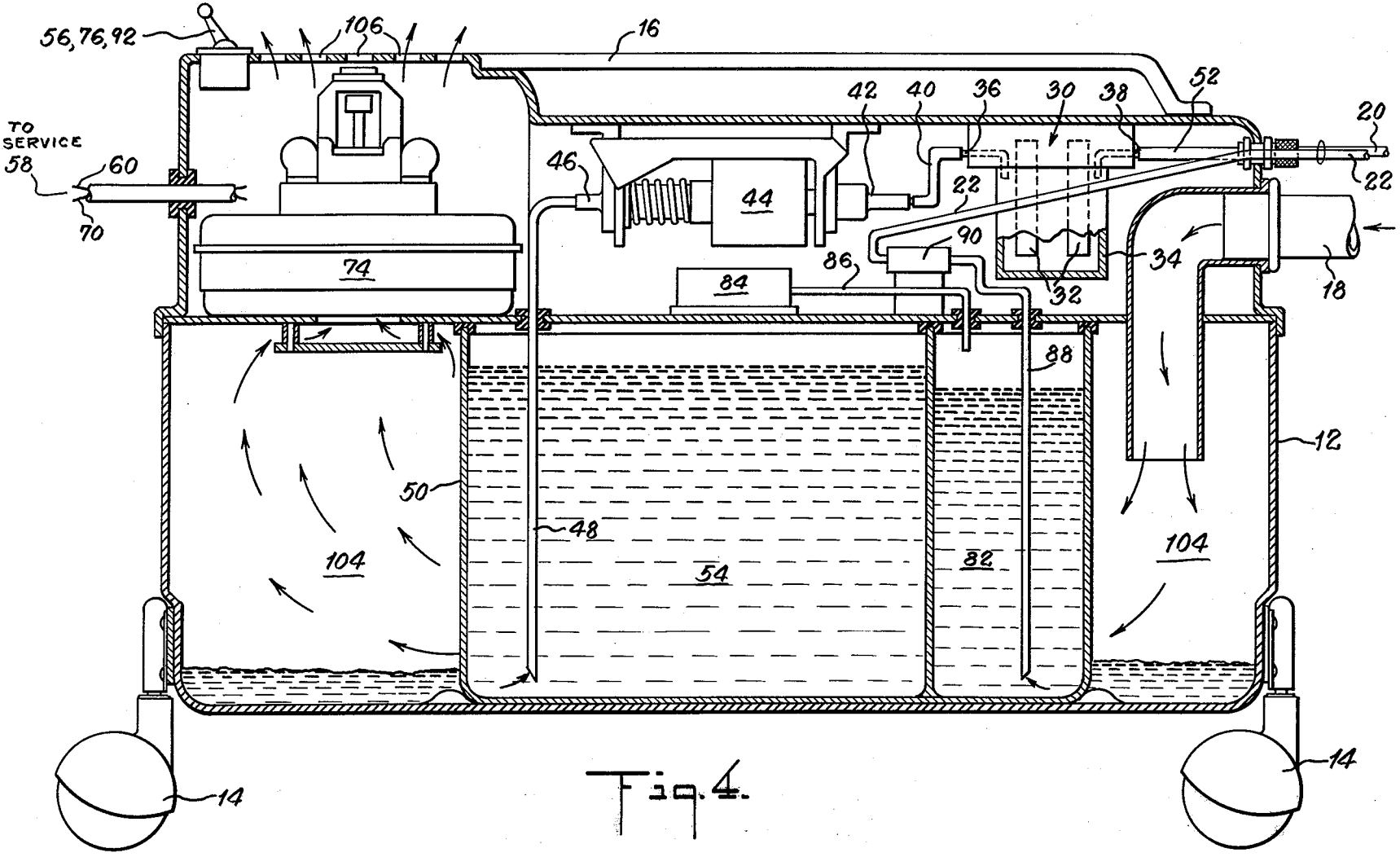
FIG. 4 is a longitudinal sectional view taken on line 4—4 of FIG. 1 showing the apparatus layout of the cleaner.

The inlet port 36 is connected by a tube 40 to an outlet port 42 of a positive displacement pump 44 and an inlet port 46 of the pump 44 is connected by a tube 48 to a tank 50 that contains for the most part water and a chemical, such as ammonium nitrate ($NH_4NO_3$), as will be brought out hereinafter. The outlet port 38 of the steam generator 30 is connected by a tube 52 to the steam hose 20.

Figure 5:
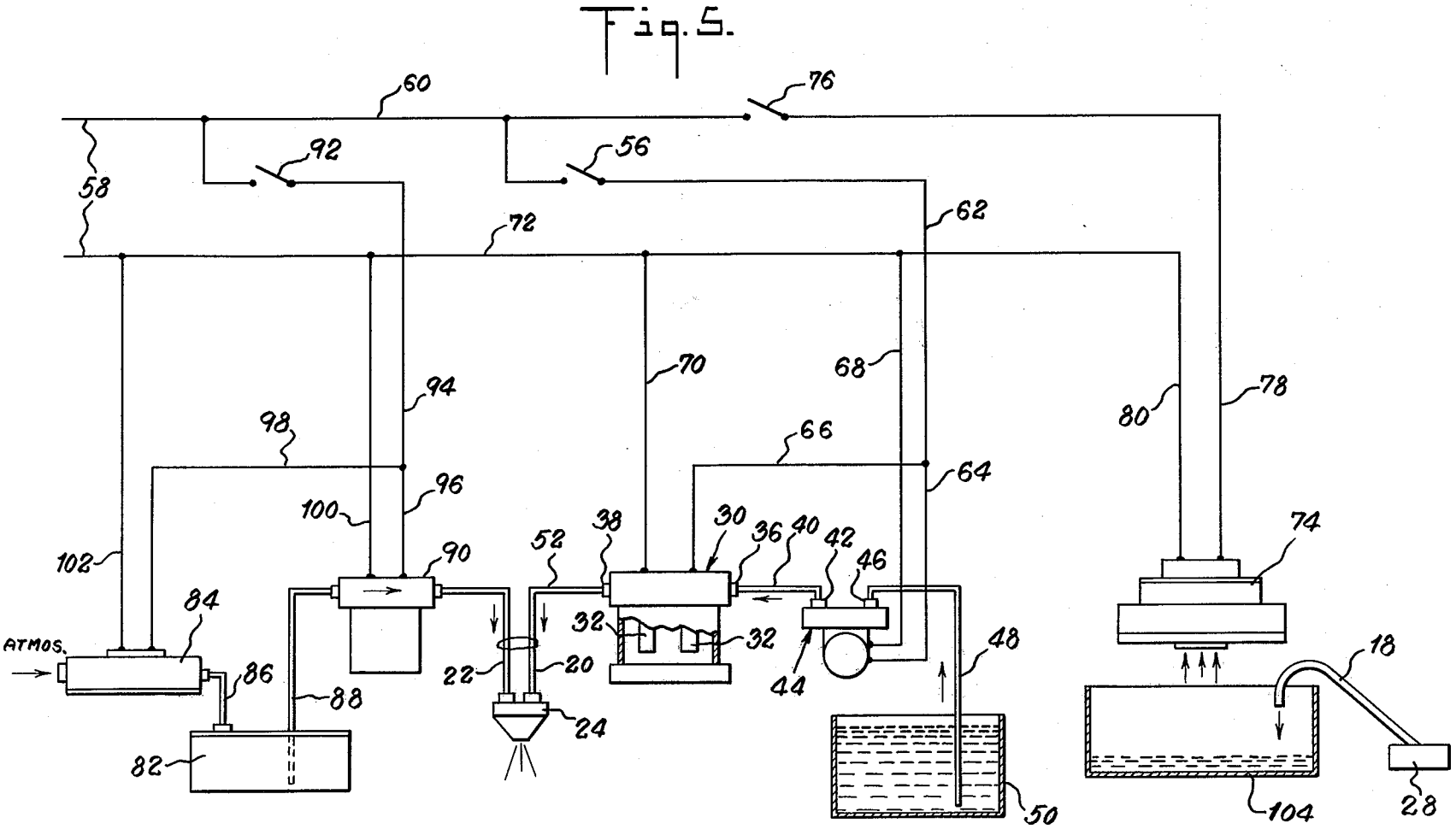
FIG. 5 is a block diagram of the combined steam and vacuum cleaner.

As indicated hereinbefore, the electrolytic steam generator 30 can generate steam within seconds, roughly 7 seconds. It has been discovered that the quickness with which the steam can be generated is attributable to mixing with the water in the tank 50 a small amount of ammonium nitrate in a ratio of about 2.5 grams of ammonium nitrate to a liter of water, forming a solution 54. Ammonium nitrate is a non-toxic chemical and can be safely used. Other non-toxic chemicals, such as sodium chloride, sodium hydroxide, etc., may also be used, but ammonium nitrate is preferred. An important feature of this invention resides in the fact that the steam generator 30 may be used by itself, that is, separately from the vacuuming function, for cleaning automotive engines and soiled areas by utilizing the steam hose 20 alone for such purposes. In other words, the positive displacement pump 44 draws the solution 54 from the tank 50 via the tube 48 and delivers it to the steam generator 30 via the tube 40, after which the generated steam is discharged from the steam hose 20. Referring particularly to FIG. 5, both the electrolytic generator 30 and the positive displacement pump 44 are energized by actuating a toggle switch 56, the circuit for which can be traced from an alternating current source 58 of electricity via lead 60, closed contacts of switch 56, lead 62, and thence in parallel paths over leads 64 and 66 to the pump 44 and steam generator 30, respectively, with the return paths therefrom being via leads 68, 70 and 72 to the source 58.

For the additional vacuuming operation there is included a vacuum motor 74 energized by actuating a toggle switch 76 that can be traced from the source 58 via lead 60, closed contacts of switch 76, and lead 78 to the motor 74 and back to the source 58 via leads 80 and 72. In conjunction with the vacuuming of carpets it is usual to provide a detergent with the steam. Accordingly, there is shown a detergent tank 82, an air pump 84 connected to the tank 82 by a tube 86 and by a tube 88 from the tank 82 for forcing the detergent through a solenoid valve 90 and thence out through the detergent hose 22. Both the solenoid valve 90 and air pump 84 are energized by actuation of a toggle switch 92 that can be traced from source 58 via lead 60, closed contacts of switch 92, lead 94 and thence in parallel paths over leads 96 and 98 to the solenoid valve 90 and air pump 84, respectively, with the return paths therefrom being via leads 100, 102 and 72 to the source 58.

In operation and assuming that a carpet is to be cleaned, the steam generator 30 is first energized by actuating switch 56, so that in a few seconds steam can be emitted by the steam hose 20, switch 92 is then actuated to emit the detergent from hose 22 and shortly thereafter the switch 76 is actuated to operate the vacuum motor 74 which conventially sucks up the excess liquid and soil, as indicated by the arrows in FIGS. 3 and 4, from the carpet via cleaning nozzle 28 and vacuum hose 18 into a tank 104 and which exhausts the air into the atmosphere through vents 106. Upon completion of the cleaning operation, all three toggle switches 56, 76 and 92 are actuated to their open positions.

From the foregoing description, it will be seen that a novel steam generator can produce steam in a matter of seconds and that the resultant steam can be used singly in cleaning soiled parts and jointly with a detergent and vacuum motor clean carpets and rugs. In view of its lightness and portability the cleaning machine of this invention can be used in dwellings for cleaning carpets and rugs and also in various types of shops for steam cleaning automotive engines and soiled parts.

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. A portable steam cleaning machine comprising, in combination, an electrolytic generator for generating steam, said generator consisting of a pair of spaced carbon rods, a sealed receptacle for containing said carbon rods, said receptacle having an inlet port and an outlet port, a positive displacement pump having an inlet port and an outlet port, a tank for holding a liquid solution, tubular means for interconnecting said tank and said inlet port of said pump, tubular means for interconnecting said outlet port of said pump and said inlet port of said receptacle, tubular nozzle means including tubular means having one end connected to said outlet port of said receptacle, and electrical means for simultaneously energizing said carbon rods and said pump, whereby liquid from said tank is fed by said pump into said receptacle to contact both of said carbon rods and close an electrical circuit for said electrolytic generator for producing substantially instant steam to be discharged from said nozzle means upon a surface to be cleaned.

2. A portable steam cleaning machine in accordance with claim 1, wherein said liquid solution consists mainly of water and a small amount of ammonium nitrate.

3. A portable steam cleaning machine in accordance with claim 2, wherein said ammonium nitrate is mixed with water in a ratio of about 2.5 grams of ammonium nitrate to a liter of water to form said liquid solution.

4. A portable steam cleaning machine in accordance with claim 2, wherein said electrical means include a switch connected to an electrical source of energy and an electrical circuit in series with said switch for activating said carbon rods and said positive displacement pump.

5. A portable steam cleaning machine in accordance with claim 4, wherein said circuit includes leads in parallel for feeding energy to said carbon rods and said positive displacement pump.

6. A portable steam cleaning machine in accordance with claim 2, including a tank containing a detergent solution, said detergent tank having an inlet port and an outlet port, an air pump, tubular means interconnecting said air pump and said inlet port of said detergent tank, a solenoid valve having an inlet port and an outlet port, tubular means interconnecting said outlet port of said detergent tank and said inlet port of said solenoid valve, tubular means interconnecting said outlet port of said solenoid valve and said nozzle means, and a second electrical means for energizing said air pump and said solenoid valve, whereby atmospheric air is pumped into said detergent tank by said air pump, thereby forcing detergent from said detergent tank through said solenoid valve and thence discharged from said nozzle means in conjunction with said steam discharge.

7. A portable steam cleaning machine in accordance with claim 6, wherein said second electrical means include a second switch connected to said electrical source of energy and a second electrical circuit in series with said second switch for activating said air pump and said solenoid valve.

8. A portable steam cleaning machine in accordance with claim 7, wherein said second circuit includes leads in parallel for feeding energy to said air pump and said solenoid valve.

9. A portable steam cleaning machine in accordance with claim 8, including a vacuum motor, a hose with a suction chamber, a suction tank, said hose having one end exhausting into said suction tank and having its suction chamber terminating in said nozzle means, and a third electrical means for energizing said motor, whereby suction produced by the motor renders the suction chamber and nozzle means effective to pick up soil loosened by said steam and detergent from a carpet being cleaned and deposited into said suction tank by said hose.

10. A portable steam cleaning machine in accordance with claim 9, wherein said third electrical means include a third switch connected to said electrical source of energy and a third electrical circuit in series with said third switch for activating said vacuum motor.

11. A portable steam cleaning machine comprising, in combination, a casing, a plurality of casters attached to said casing for ready movement thereof, an electrolytic generator for generating steam consisting of a pair of spaced carbon rods, a sealed receptacle mounted within said casing for containing said carbon rods, a positive displacement pump mounted within said casing adjacent to said receptacle, a tank mounted within said casing for holding a liquid solution consisting mainly of water and a small amount of ammonium nitrate, tubular means for connecting said positive displacement pump to said tank and to one side of said receptacle, tubular nozzle means having one end connected to another side of said receptacle, and electrical means for energizing said carbon rods and said positive displacement pump, whereby liquid from said tank is fed by said positive displacement pump into said receptacle to contact both of said carbon rods and close an electrical circuit for said electrolytic generator for producing substantially instant steam to be discharged from said nozzle means upon a surface to be cleaned.

12. A portable steam cleaning machine in accordance with claim 11, including a tank containing a detergent solution mounted within the casing, an air pump mounted within said casing, a solenoid valve mounted within said casing adjacent to said air pump, tubular means interconnecting said air pump and said detergent tank, tubular means interconnecting said detergent tank and one side of said solenoid valve, tubular means interconnecting another side of said solenoid valve and said nozzle means, and a second electrical means for energizing said air pump and said solenoid valve, whereby atmospheric air is pumped into said detergent tank by said air pump to force detergent solution from said detergent tank through said energized solenoid valve and discharged from said nozzle means in conjunction with said steam discharge.

13. A portable steam cleaning machine in accordance with claim 12, including a vacuum motor mounted within said casing, a suction tank mounted within said casing contiguous to said vacuum motor, a hose having one end disposed within said suction tank and having its other end included as part of said nozzle means, and a third electrical means for energizing said vacuum motor, whereby suction produced by said vacuum motor renders the nozzle means effective to pick up soil loosened by said steam and detergent from a surface of a carpet being cleaned and deposited into said suction tank by said hose.

* * * * *